US006039608A

United States Patent [19]

Amero, Jr. et al.

[11] Patent Number: 6,039,608

[45] Date of Patent: Mar. 21, 2000

[54] ADAPTER SYSTEM

[75] Inventors: Willard F. Amero, Jr., Flowery Branch; John E. Herrmann, Lawrenceville, both of Ga.

[73] Assignee: Motorola, Inc., Schaumburg, Ill.

[21] Appl. No.: 09/031,605

[22] Filed: Feb. 27, 1998

[51] Int. Cl.[7] ..... H01R 25/00

[52] U.S. Cl. ..... 439/651; 439/518

[58] Field of Search ..... 439/171, 172, 439/337, 518, 651, 653

[56] References Cited

U.S. PATENT DOCUMENTS 3,525,971 8/1970 Glassman ..... 439/651

4,736,177 4/1988 Vollmer et al. ..... 439/651 X 5,613,863 3/1997 Klaus et al. ..... 439/518 X 5,616,051 4/1997 Rogers et al. ..... 439/171 X

*Primary Examiner*—Khiem Nguyen

*Attorney, Agent, or Firm*—Felipe S. Farley; Philip Burrus

[57] ABSTRACT

An adapter system comprising an adapter with plug prongs on its front face and apertures on its back face, and adapter contacts within it, and a power supply with power supply prongs disposed outwardly, which prongs have undercuts at their distal ends; where the power supply contacts can be inserted into the apertures of the adapter, and the adapter is then rotated around the axis of insertion, mechanically securing the adapter to the power supply and simultaneously making electrical contact between the adapter and the power supply.

3 Claims, 4 Drawing Sheets

ADAPTER SYSTEM

TECHNICAL FIELD

This invention relates in general to plug mechanism, and more particularly in the field of interchangeable plug mechanisms.

BACKGROUND OF THE INVENTION

Many electrical devices draw power from a commercial source, usually delivered to the user through a wall outlet or socket. While many electrical devices are sold for use throughout the world, there is no world standard for electrical plug configuration, size, shape, position or number of prongs. The wide variety of socket configurations in use world wide is a burden on international suppliers of products, and on international travelers who wish to use electrical devices in varied locations.

While there is no world standard for power supply voltage or frequency, many electronic devices and almost all battery powered electrical devices run on direct current. Therefore, it is not difficult to design a universal power supply which converts alternating current into direct current suitable for a particular device. However, the problem still remains of physically connecting an alternating current source supplied through a large number of outlet configurations. Therefore, there is a need for a plug adapter system which can easily accommodate various types of plugs, yet is safe and strong.

DETAILED DESCRIPTION OF THE PREFERRED EMBODIMENT

The present invention is an adapter system comprising an adapter with plug prongs on its front face and apertures on its back face, and adapter contacts within it, and a power supply with power supply prongs disposed outwardly, where the prongs have an undercut at their distal end. The power supply contacts are inserted into the corresponding apertures of the adapter, and the adapter is then rotated around the axis of insertion. This rotation mechanically secures the adapter to the power supply, and simultaneously makes electrical contact between the adapter and the power supply, through contact of the undercut with the adapter contacts.

Figure 8:
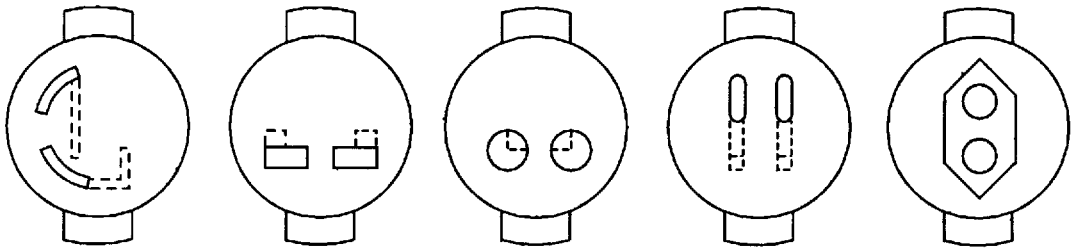
FIG. 8 shows a variety of global plug attachments.

As shown in FIG. 8, there is a wide variety of designs for plug attachments around the world. This prevents a quandary to manufacturers of electrical items sold worldwide. The design of any adapter to be used with a power supply must be versatile, make firm electrical contact, sturdy mechanical contact, and above all, must be safe. This is accomplished by the present invention.

Figure 1:
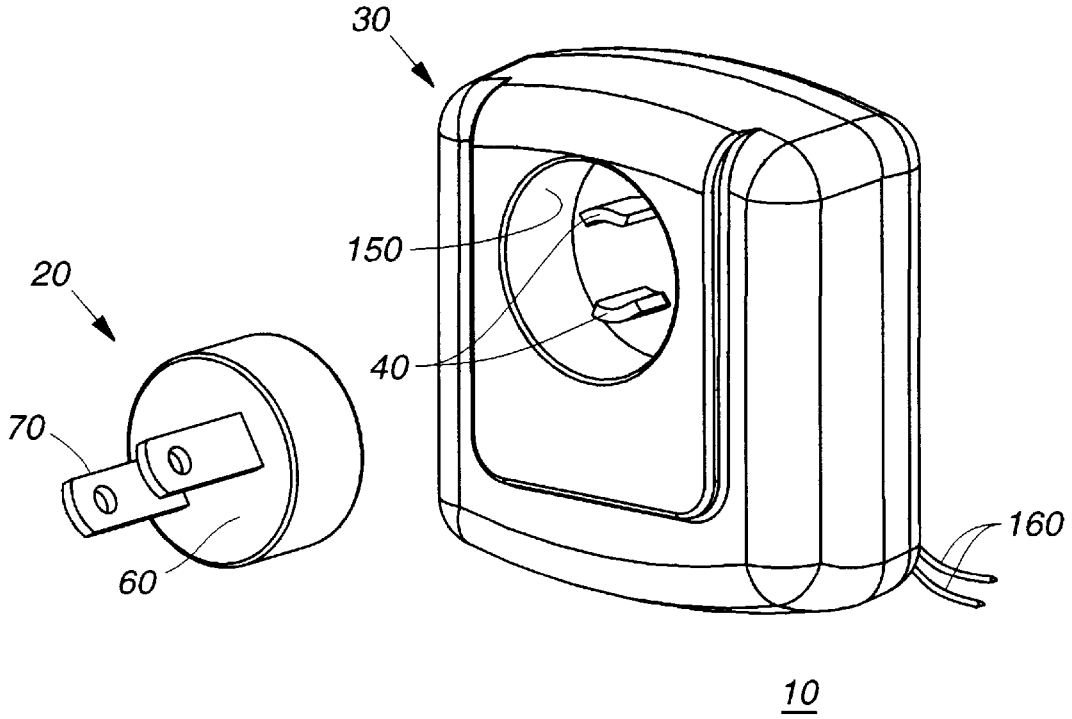
FIG. 1 is a perspective drawing of the adapter system of the present invention showing the adapter and the power supply.

As shown in FIG. 1, the adapter system 10 of the present invention comprises an adapter 20 and a power supply 30. The prongs 70 outwardly disposed from the face 60 of the adapter 20 happens to be in a North American configuration. The power supply 30 has an electrical connection 160 leading from the power supply to the device requiring power. The power supply prongs 40 are in a recession 150 so that they are below the surface of the power supply 30 and cannot be plugged into a wall outlet.

Figure 2:
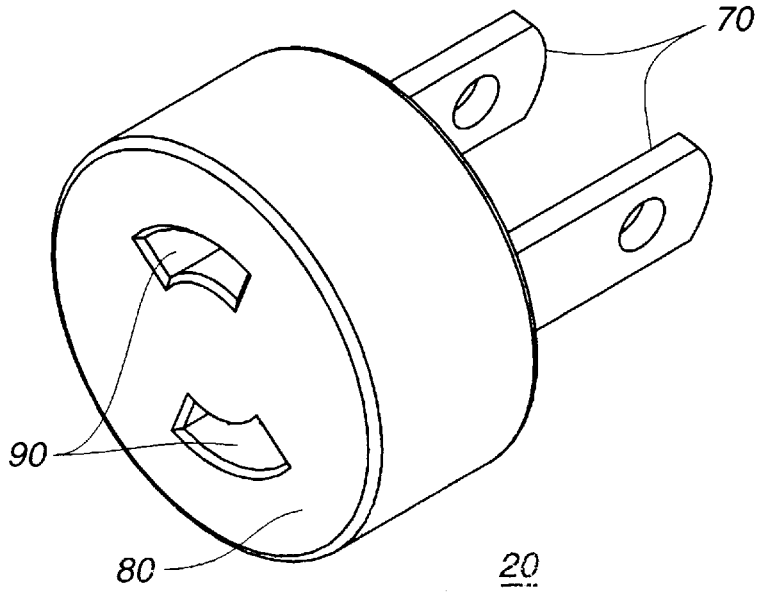
FIG. 2 is a perspective drawing of the adapter of the present invention showing the back face of the adapter.
Figure 3:
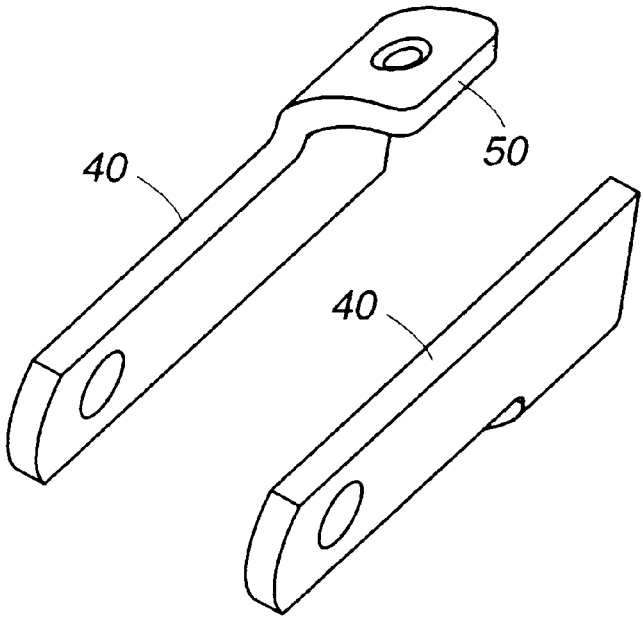
FIG. 3 is a perspective view of the power supply prongs showing the undercut.
Figure 4:
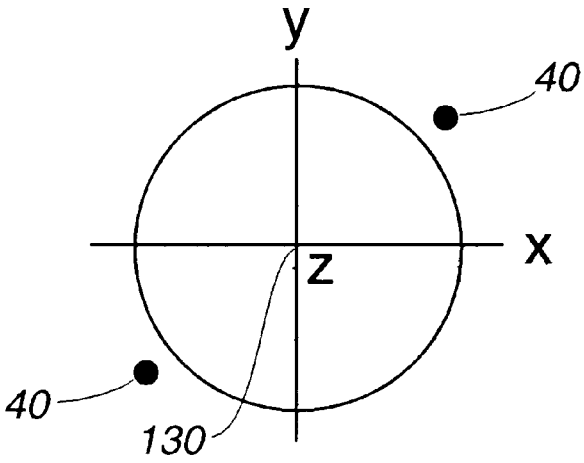
FIG. 4 is a schematic of the xyz plane in which the axis of the insertion of the power supply prongs into the back of the adapter lies along the z plane, which is perpendicular to the paper.
Figure 5:
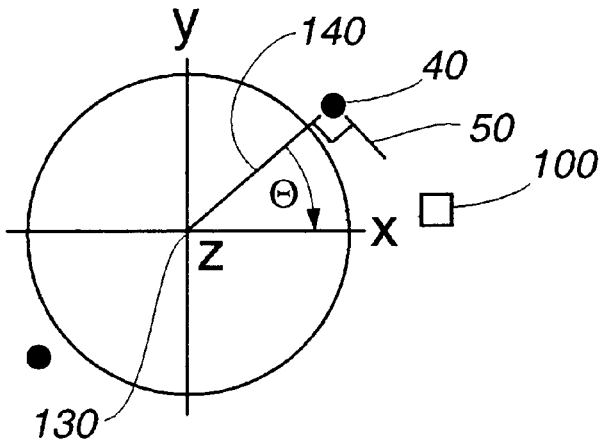
FIG. 5 is another drawing of the xyz coordinate system, showing the axis of insertion of the power supply prongs into the adapter. It also shows the undercut, perpendicular to the radius in the xy plane whose origin is at (0,0).
Figure 6:
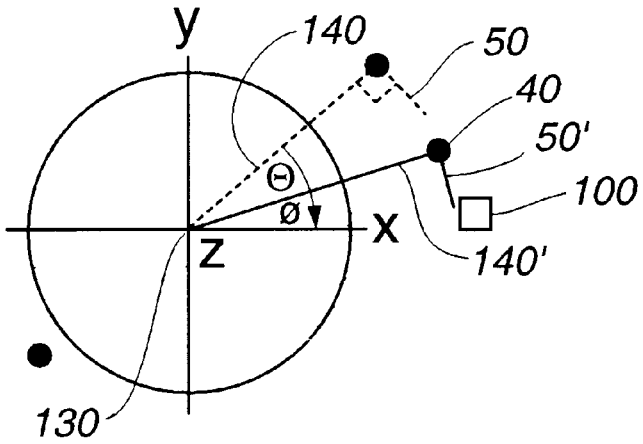
FIG. 6 shows the undercut of FIG. 5, as the adapter has rotated and the undercut is locked mechanically, and has made electrical contract with the adapter contact.
Figure 7:
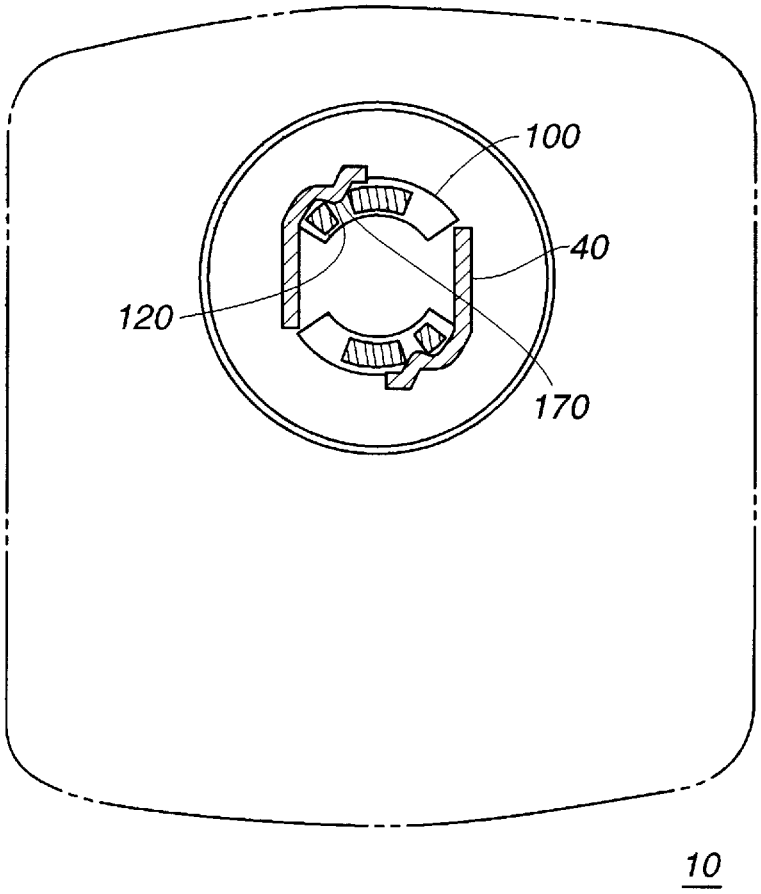
FIG. 7 shows the interior of the adapter mechanism when it is joined to the power supply, locked mechanically, and contacting electrically.

FIG. 2 is a perspective view of the back face 80 of the adapter 20. The backface 80 has apertures 90 to admit power supply prongs 40. FIG. 3 is an expanded view of power supply prongs 40 showing the undercut 50, which in one embodiment of the invention provides both the mechanical locking function and the electrical contact. This may be further understood with references to FIGS. 4 and 5. FIGS. 4 and 5 show graphs of the xyz coordinate system. Imagining the prongs 40 of the power supply to be rods, these are shown as points, where the rods are perpendicular to the x-y plane. The x-y plane lies in the paper, and this plane is imagined as roughly parallel to the back face 80 and front face 60 of the adapter, lying between the two, in the interior of the adapter 20. The axis of insertion (130) of the prongs 40 of the power supply into the apertures 90 lies between the rods (40). the axis of insertion (130) herein shown as the z axis is also perpendicular to the plane of the paper. FIG. 5 shows a rod 40 and the undercut 50, here shown as a line segment in the xyz plane which is the plane of the paper. The undercut (50) is perpendicular to the radius (140) perpendicular to the z axis. The undercut 50 lies in the x-y plane. To mechanically lock the adapter 20 to the power supply 30, the adapter is pushed onto the prongs 40 of the power supply. The prongs 40 of the power supply fit into the corresponding shaped apertures 90 in the back of the adapter. This is a fairly close fit, which provides just enough room for the prongs of the power supply 40 and the undercut 50 to fit into the apertures 90 in the back face of the adapter. When the adapter 20 is rotated along the z axis, from angle theta to angle phi as shown in FIG. 6, the apertures 90 in the back of the adapter still lie along the line segment marked "before" but now the undercut 50 behind the backface 80 of the adapter, along the line segment marked "after". The adapter 20 is now mechanically locked to the power supply 30 because the undercut 50 cannot be pulled out along the axis of insertion 130 through the back face 80 of the adapter. Furthermore, the undercut 50 is now touching adapter contact 100 within adapter 20, making electrical contact. In other words, adapter 20 is now mechanically locked to power supply 30, and is in electrical contact with the power supply. All that was necessary was that the adapter 20 was pushed onto the prongs 40 of the power supply and then was rotated along the axis 130 of insertion. This invention performs a salutary function: a contact is not live electrically until it is locked mechanically. Furthermore, the present invention preserves the important convention in the electronic power industry: only female arrangements are live. FIG. 7 shows a cut-away view of the adapter system 10 where the power supply 30 has been mated to the adapter 20. Shown are the internal adapter contacts 100 mated to the power supply prongs 40. In this embodiment, a groove 120 in the power supply prongs 40 fits with a corresponding outcropping 170 in the power supply prong.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. An adapter system comprising a. an adapter with plug prongs on its front face and apertures on its back face, and adapter contacts within it; and b. a power supply with power supply prongs disposed outwardly, which prongs have undercuts at their distal ends;

where the power supply contacts can be inserted into the apertures of the adapter, and the adapter is then rotated along the axis of insertion, mechanically securing the adapter to the power supply and simultaneously making electrical contact between the adapter and the power supply.

2. The adapter system of claim 1, further comprising a recession in the face of the power supply, wherein the power supply prongs are located within the recession.

3. The power supply of claim 1, wherein the undercut includes a groove, and the adapter contact includes a corresponding outcropping.

* * * * *